US006213727B1

(12) United States Patent
Kawaguchi

(10) Patent No.: US 6,213,727 B1
(45) Date of Patent: Apr. 10, 2001

(54) VARIABLE DISPLACEMENT COMPRESSOR AND OUTLET CONTROL VALVE

(75) Inventor: Masahiro Kawaguchi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/372,732

(22) Filed: Aug. 11, 1999

(30) Foreign Application Priority Data

Aug. 17, 1998 (JP) ..... 10-230903

(51) Int. Cl.[7] ..... F04B 1/26
(52) U.S. Cl. ..... 417/222.2; 417/569
(58) Field of Search ..... 417/222.1, 222.2, 417/569

(56) References Cited

U.S. PATENT DOCUMENTS

| | | | | |
|---|---|---|---|---|
| 4,231,713 | * | 11/1980 | Widdowson et al. | 417/222.1 |
| 4,687,419 | * | 8/1987 | Suzuki et al. | 417/222.2 |
| 4,990,063 | * | 2/1991 | Oono et al. | 417/222.1 |
| 5,000,666 | * | 3/1991 | Esaki | 417/222.2 |
| 5,145,326 | | 9/1992 | Kimura et al. | 417/222.2 |
| 5,165,863 | * | 11/1992 | Taguchi | 417/222.2 |
| 5,227,552 | * | 7/1993 | Higuchi | 417/222.2 |
| 5,282,329 | | 2/1994 | Teranishi | 137/596.17 |
| 5,286,172 | * | 2/1994 | Taguchi | 417/222.2 |
| 5,486,098 | * | 1/1996 | Kimura et al. | 417/222.2 |
| 5,588,807 | * | 12/1996 | Kimura et al. | 417/222.2 |
| 5,616,008 | * | 4/1997 | Yokono et al. | 417/222.2 |
| 5,702,235 | * | 12/1997 | Hirota et al. | 417/222.2 |
| 6,099,276 | * | 8/2000 | Taguchi | 417/569 |

FOREIGN PATENT DOCUMENTS 198 05 126 A1 8/1998 (DE) .

* cited by examiner

*Primary Examiner*—Teresa Walberg
*Assistant Examiner*—Leonid Fastovsky
(74) *Attorney, Agent, or Firm*—Morgan & Finnegan, L.L.P.

(57) ABSTRACT

A variable displacement compressor has a suction chamber, a discharge pressure zone and a bleeding passage. The bleeding passage conducts refrigerant from a crank chamber to the suction chamber. A control valve has a valve chamber and a valve body. The valve chamber forms a part of the bleeding passage. The valve body adjusts the opening amount of the bleeding passage. An adjuster rod urges the valve body in one direction in accordance with the discharge pressure. The adjuster rod is movably supported by a guide hole. A passage is formed between the adjuster rod and the guide hole to draw refrigerant gas from the discharge pressure zone to the crank chamber. This construction permits the compressor to quickly change its displacement. The compressor of this structure is suitable for mass production.

15 Claims, 4 Drawing Sheets

VARIABLE DISPLACEMENT COMPRESSOR AND OUTLET CONTROL VALVE

BACKGROUND OF THE INVENTION

The present invention relates to a variable displacement compressor that controls the inclination of a drive plate by adjusting the amount of refrigerant gas bled from a crank chamber. More particularly, the invention pertains to an outlet control valve used in such a compressor.

A typical variable displacement compressor has a drive shaft, which is rotatably supported in a crank chamber defined in the compressor housing. The housing includes a cylinder block. Cylinder bores are formed in the cylinder block. A piston is reciprocally housed in each cylinder bore. An inclined drive plate, or swash plate, is supported by the drive shaft in the crank chamber. The swash plate rotates integrally with and inclines with respect to the drive shaft. The swash plate converts rotation of the drive shaft into reciprocation of the pistons.

The inclination of the swash plate varies in accordance with the pressure in the crank chamber. The stroke of the pistons is changed according to the inclination angle of the swash plate, which varies the displacement of the compressor. To control the crank chamber pressure, either the flow rate of refrigerant gas delivered to the crank chamber or the flow rate of refrigerant gas released from the crank chamber must be controlled.

To control the amount of gas delivered to the crank chamber, an inlet control valve is located in a passage connecting the discharge chamber to the crank chamber. The crank chamber is connected to a suction chamber by a bleeding passage. A fixed restrictor is formed in the bleeding passage. The control valve adjusts the amount of refrigerant gas supplied to the crank chamber from the discharge chamber, thereby setting the crank chamber pressure to a desired level.

To control the amount of gas released from the crank chamber, an outlet control valve is located in a bleeding passage, which connects the crank chamber to the suction chamber. When a piston compresses refrigerant gas in the associated cylinder bore, refrigerant gas in the cylinder bore leaks into the crank chamber between the surface of the piston and the wall of the cylinder bore. The leaking gas is referred to as blowby gas. The blowby gas increases the pressure of the crank chamber. The outlet control valve adjusts the amount of refrigerant flowing from the crank chamber to the suction chamber thereby setting the crank chamber pressure to a desired pressure.

Using the outlet control valve, the crank chamber pressure is changed in accordance with the amount of refrigerant gas bled from the crank chamber. Therefore, to quickly change the crank chamber pressure, sufficient blowby gas must be constantly supplied to the crank chamber. However, blowby gas is a mere byproduct of gas compression by the piston. Thus, it is difficult to quickly change the crank chamber pressure using only blowby gas. Further, the amount of blowby gas is varied according to the rotation speed of the swash plate. Particularly when the swash plate speed is low, the amount of blowby gas is not sufficient. Therefore, the inclination of the swash plate, or the compressor displacement, cannot be changed quickly.

Providing a constant, adequate supply of blowby gas to the crank chamber is difficult. To avoid this problem, a supply passage may be provided to supply refrigerant gas from the discharge chamber to the crank chamber. However, the diameter of the supply passage needs to be extremely small (for example, 0.1 to 0.5 millimeters). Forming such narrow passages in compressor housings with a drilling machine shortens the life of the drilling machine. Compressor housings having such a supply passage are therefore not suitable for mass production.

SUMMARY OF THE INVENTION

Accordingly, it is an objective of the present invention to provide a variable displacement compressor and an outlet control valve that quickly adjust the compressor displacement and are suitable for mass production.

To achieve the foregoing and other objectives and in accordance with the purpose of the present invention, a variable displacement compressor for varying displacement according to the inclination of a drive plate located in a crank chamber is provided. The compressor includes a suction pressure zone, the pressure of which is a suction pressure, and a discharge pressure zone, the pressure of which is a discharge pressure. The compressor also includes a bleeding passage for bleeding refrigerant gas from a crank chamber to the suction pressure zone and valve for regulating the bleeding passage. The valve controls the flow of refrigerant gas from the crank chamber to the suction pressure zone such that the valve adjusts the pressure of the crank chamber, and the inclination of the drive plate varies in accordance with the pressure in the crank chamber. The valve has a valve body, which adjusts the opening area of the bleeding passage, an adjuster body, which acts on the valve body, and a housing that houses the adjuster body. A supply passage is formed between the adjuster body and the housing to guide refrigerant gas from the discharge pressure zone to the crank chamber.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompaning drawings in which:

DETAILED DESCRIPTION OF THE PREFERRED EMBODIMENTS

A first embodiment of the present invention will now be described with reference to FIGS. 1 to 3.

Figure 1:
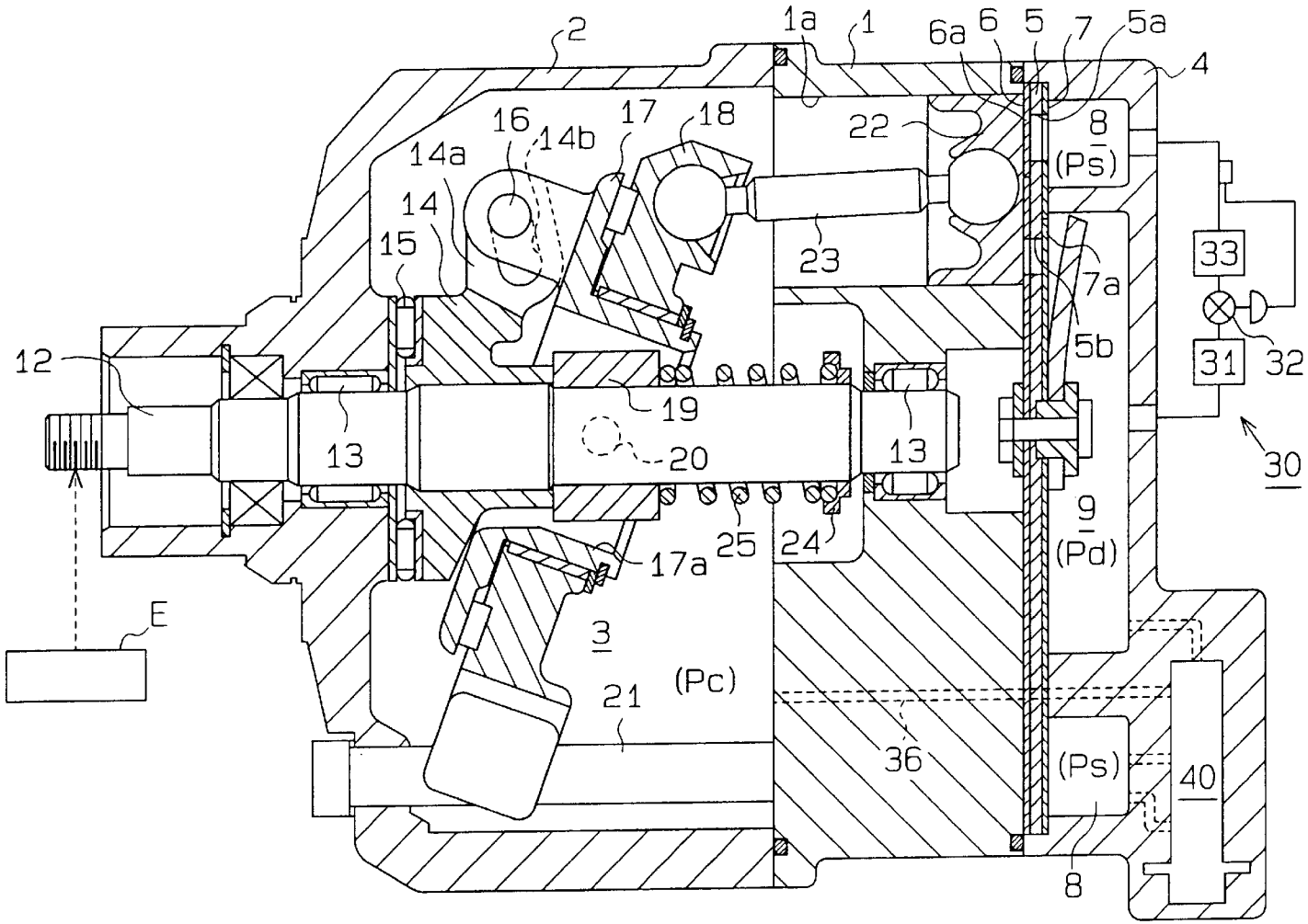
FIG. 1 is a cross-sectional view illustrating a variable displacement compressor according to a first embodiment of the present invention.

As shown in FIG. 1, a front housing 2 and a rear housing 4 are secured to a cylinder block 1. Cylinder bores 1*a* (only one is shown) are formed in the cylinder block 1. A valve plate 5 is located between the cylinder block 1 and the rear housing 4. A crank chamber 3 is defined between the front housing 2 and the cylinder block 1. The cylinder block 1, the front housing 2 and the rear housing 4 form the compressor housing.

The valve plate 5 includes a suction valve plate 6 and a discharge valve plate 7. The suction valve plate 6 has suction valve flaps 6*a,* each of which corresponds to one of the cylinder bores 1*a*. The discharge valve plate 7 has discharge valve flaps 7*a,* each of which corresponds to one of the cylinder bores 1*a*. A suction chamber 8 and a discharge chamber 9 are defined in the rear housing 4. Suction ports 5*a* and discharge ports 5*b* are formed in the valve plate 5. Each cylinder bore 1*a* is connected to the suction chamber 8 by one of the suction ports 5*a*. Also, each cylinder bore 1*a* is connected to the discharge chamber 9 by one of the discharge ports 5*b*.

A drive shaft 12 is rotatably supported by a pair of bearings 13 in the cylinder block 1 and the front housing 2. The drive shaft 12 is coupled to an external drive source, or engine E, by a pulley, a belt and an electromagnetic clutch (none of which is shown). A rotating support 14 is secured to the drive shaft 12 in the crank chamber 3. The rotating support 14 rotates integrally with the drive shaft 12. A thrust bearing 15 is located between the rotating support 14 and the inner wall of the front housing 2. The rotating support 14 has a support arm 14*a*. A guide slot 14*b* is formed in the support arm 14*a*. A drive plate 17 is fitted about the drive shaft 12. The drive plate 17 has a front projection, from which a pin 16 extends. The pin 16 is engaged with the guide slot 14*b*. Cooperation of the pin 16 and the support arm 14*a* allows the drive plate 17 to rotate integrally with the drive shaft 12.

A sleeve 19 is slidably fitted to the drive shaft 12. The sleeve 19 is coupled to a boss 17*a* of the drive plate 17 by a pair of coupling pins 20 (only one is shown). The sleeve 19 allows the drive plate 17 to move along the axis of the drive shaft 12, and the pins 20 allow the drive plate 17 to pivot about the pins 20. A wobble plate 18 is fitted about the boss 17*a* of the drive plate 17 to be rotatable relative to the drive plate 17. A guide rod 21 located in the crank chamber 3 prevents the wobble plate 18 from rotating while allowing the plate 18 to incline. The wobble plate 18 is coupled to each piston 22 by a piston rod 23. A spring seat 24 is fitted to the drive shaft 12. A coil spring 25 is fitted about the drive shaft 21 between the spring seat 24 and the sleeve 19. The spring 25 urges the plates 17, 18 to left as viewed in FIG. 1, or in a direction increasing the inclination of the plates 17, 18.

As shown in FIG. 1, the discharge chamber 9 is connected to the suction chamber 8 by an external refrigerant circuit 30. The external refrigerant circuit 30 and the compressor form a vehicle cooling circuit. The refrigerant circuit 30 includes a condenser 31, an expansion valve 32 and an evaporator 33. The expansion valve 32 maintains a pressure difference between the condenser 31 and the evaporator 33. Also, the expansion valve 32 controls the amount of refrigerant supplied to the evaporator 33 in accordance with the thermal load applied to the circuit 30. The expansion valve 32 is feedback controlled based on the temperature at the outlet of the evaporator 33 and on the pressure at the inlet or the outlet of the evaporator 33. Accordingly, the amount of circulating refrigerant in the circuit 30 is controlled such that the degree of superheating of gasified refrigerant in the evaporator 33 is maintained at a proper level.

When the drive shaft 12 is rotated by the external drive source E, the inclined drive plate 17 is rotated. The rotation of the drive plate 17 causes the wobble plate 18 to wobble. The wobbling movement of the wobble plate 18 is converted into reciprocation of each piston 22. Each piston 22 reciprocates with a stroke corresponding to the inclination of the plates 17, 18, which draws refrigerant gas from the suction chamber 8 to the associated cylinder bore 1*a*, and discharges compressed refrigerant gas from the cylinder bore 1 to the discharge chamber 9.

The inclination of the plates 17, 18 is determined based on a moment resulting from centrifugal force, a moment resulting from the force of the spring 25 and a moment resulting from the gas pressure applied to the pistons 22. The moment based on centrifugal force and the moment based on the spring 25 always act to increase the inclination of the plates 17, 18. The moment based on the gas pressure acts to decrease the inclination of the plates 17, 18. The moment based on the gas pressure is generated by the compression reaction force acting on the pistons 22 that are performing a compression stroke, the pressure in the cylinder bores 1*a* of the pistons 22 that are performing a suction stroke and the pressure (Pc) in the crank chamber 3.

Changing the crank chamber pressure Pc permits the plates 17, 18 to be at any inclination between the minimum inclination and the maximum inclination. The stroke of the pistons 22, or the compressor displacement, is controlled in accordance with the inclination of the plates 17, 18. Specifically, when the crank chamber pressure Pc is increased and the moment based on the gas pressure is greater than the sum of the moment based on centrifugal force and the moment based on the spring force, the inclination of the plates 17, 18 is decreased. The minimum inclination of the plates 17, 18 is three to five degrees. The inclination of the plates 17, 18 is represented by their angle relative to a plane perpendicular to the axis of the drive shaft 12. When the crank chamber pressure Pc is lowered and the moment based on the gas pressure is smaller than the sum of the moment based on centrifugal force and the moment based on the spring force, the inclination of the plates 17, 18 is increased. The inclination of the plates 17, 18 is unchanged when the moment based on the gas pressure and the sum of the moment based on rotation and the moment based on the spring force are in balance.

An outlet control valve 40 will now be described with reference to FIG. 2. The outlet control valve 40 includes a first valve housing 41, a second valve housing 42 and a plug 43. The second valve housing 42 is secured to the bottom of the first housing 41 and the plug 43 is located in the second valve housing 42. The first valve housing 41, the second valve housing 42 and the plug 43 form the housing of the control valve 40.

The second valve housing 42 is cylindrical and has annular steps formed on the inner wall. The lower end of the plug 43 is engaged with one of the annular steps. A disk spring 44 is engaged with another annular step. The disk spring 44 urges the plug 43 downward preventing the plug 43 from moving in the second valve housing 42.

A seal ring 45 is fitted between the inner wall of the second valve housing 42 and a groove formed in the circumferential surface of the plug 43. A valve chamber 46 is formed below the plug 43. A pressure sensing element, or diaphragm 54, is located between the first valve housing 41 and the second valve housing 42. A pressure sensing chamber 53 is defined between the diaphragm 45 and the plug 43.

An annular step 47 is formed in the inner wall of the second valve housing 42 in the axial center of the valve chamber 46. The step 47 divides the valve chamber 46 into an upper portion (suction pressure zone) and a lower portion (crank chamber pressure zone). A valve body 50 is movably housed in the valve chamber 46. The valve body 50 contacts the step 47, which serves as a valve seat, to disconnect the upper portion of the valve chamber 46 from the lower portion.

Ports 48, 49 are formed in the wall of the second valve housing 42. The ports 48 connect the upper portion of the valve chamber 46 to the suction chamber 8 by a passage 35 formed in the compressor. The ports 49 connect the lower portion to the crank chamber 3 by a passage 36 formed in the compressor. The crank chamber 3 is connected to the suction chamber 8 by a bleeding passage, which includes the passage 36, the ports 49, the valve chamber 46, the ports 48 and the passage 35. The valve body 50 is moved to change its position in the valve chamber 46. Accordingly, the area of the space between the valve body 50 and the step 47, or the opening amount of the bleeding passage, is varied.

A guide hole 51 extends in the plug 43 along the axis of the control valve 40. A pressure sensing rod 52 extends through the guide hole 51 and slides with respect to the plug 43. The lower end of the rod 52 is coupled to the valve body 50 and the upper end of the rod 52 is coupled to the lower side of the diaphragm 54 by a connector 55. The valve body 50, the rod 52 and the connector 55 are moved integrally along the axis of the control valve 40.

Pressure sensing ports 56 are formed in the wall of the second valve housing 42 above the seal ring 45. The pressure sensing ports 56 are connected to the suction chamber 8 and to the pressure sensing chamber 53 via a space defined between the plug 43 and the inner wall of the second valve housing 42. Thus, the pressure of the suction chamber 8, or the suction pressure Ps, is applied to the pressure sensing chamber 53 by the pressure sensing ports 56.

An adjuster 57 is threaded into the first valve housing 41. A hole 57*a* is formed in the center of the adjuster 57*a* to communicate the interior of the first valve housing 41 with the atmosphere. A ball seat 61 is attached to the upper side of the diaphragm 54. A spring receiver 59 is located above the ball seat 61 with a ball 60 in between. A spring 58 is located between the spring receiver 59 and the adjuster 57. A target value Pset of the suction pressure Ps is determined by the sum of the force of atmospheric pressure, which acts on the diaphragm 54, and the force of the spring 58. The target value Pset is adjusted by changing the axial position of the adjuster 57.

Figure 2:
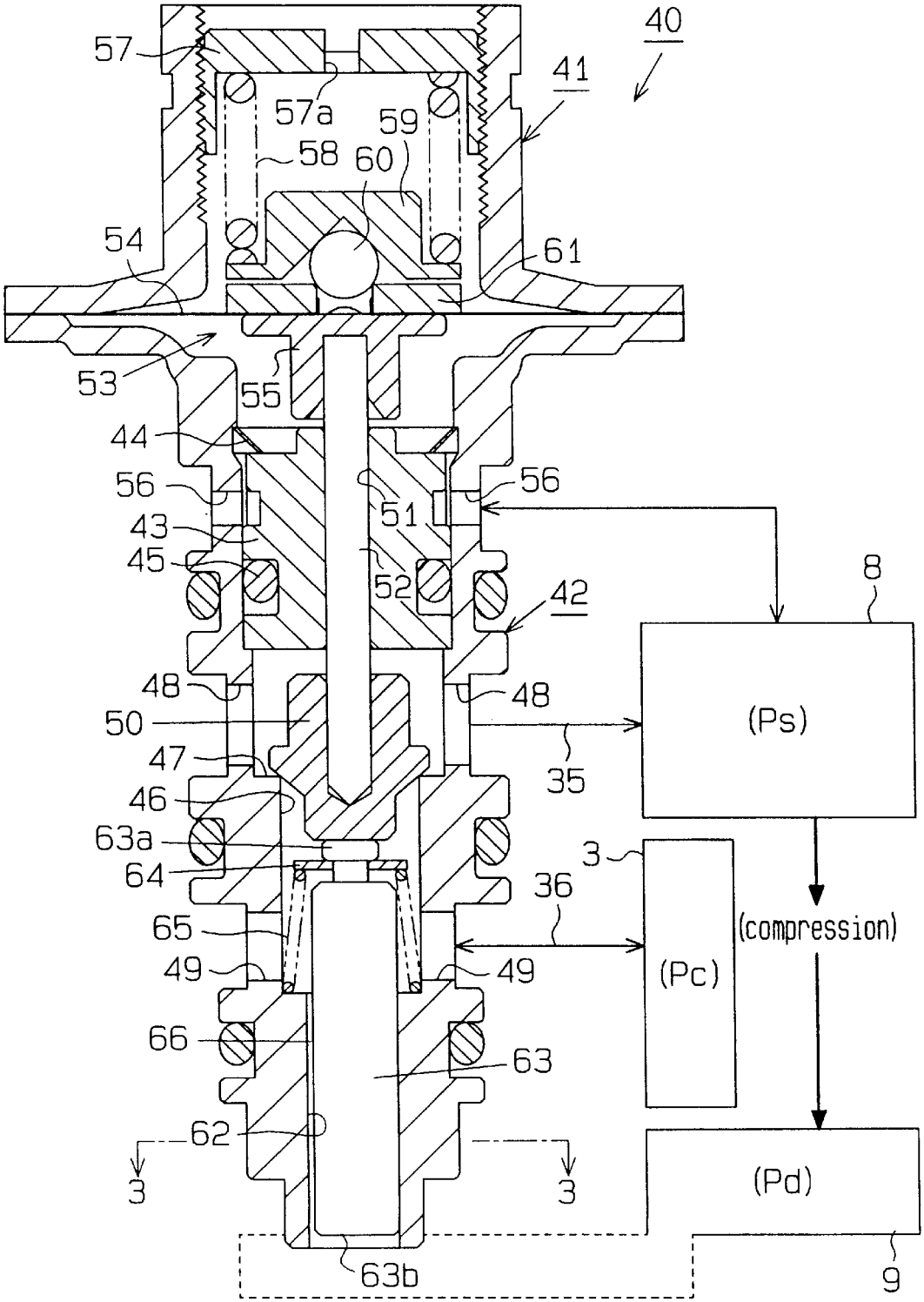
FIG. 2 is an enlarged cross-sectional view illustrating an outlet control valve in the compressor of FIG. 1.
Figure 3:
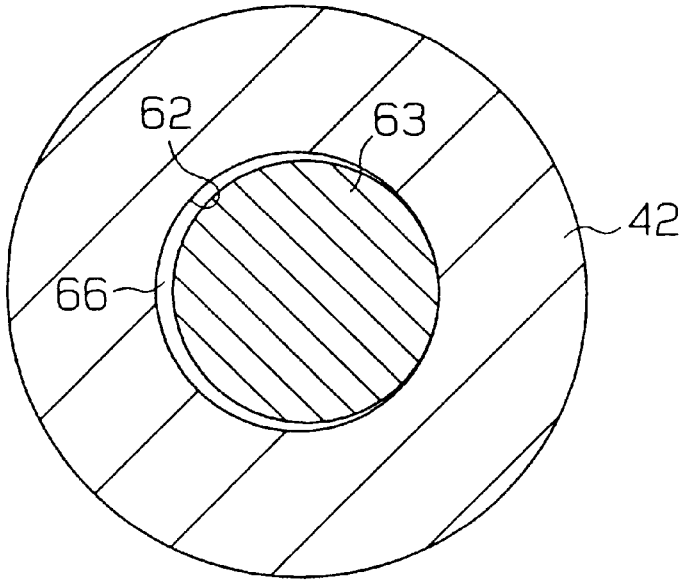
FIG. 3 is a cross-sectional view taken along line 3—3 of FIG. 2.

In the embodiment of FIGS. 1 to 3, a pressure sensing mechanism is formed by the pressure sensing rod 52, the pressure sensing chamber 53, the diaphragm 54, the connector 55, the pressure sensing ports 56, the adjuster 57, the spring 58, the spring receiver 59, the ball 60 and the ball seat 61. The pressure sensing mechanism actuates the valve body 50 in accordance with changes in the suction pressure Ps.

A guide hole 62 extends in the lower portion of the second valve housing 42 along the axis of the control valve 40. An adjuster rod 63 extends in and slides along the guide hole 62. A mushroom-shaped stopper 63*a* is formed at the upper end of the adjuster rod 63. A flange 64 is removably attached to the stopper 63*a*. A spring 65 extends between the flange 64 and the lowest step formed in the second valve housing 42. The spring 65 urges the adjuster rod 63 toward the valve body 50 through the flange 64. As a result, the stopper 63*a* is constantly pressed against the valve body 50. In other words, the adjuster rod 63 is operably coupled to the pressure sensing mechanism by the valve body 50.

A lower surface 63*b* of the adjuster rod 63 is exposed to the pressure of the discharge chamber 9, or the discharge pressure Pd. As shown in FIGS. 2 and 3, the diameter of the guide hole 62 is slightly greater than that of the adjuster rod 63 (FIGS. 2 and 3 illustrate the diameter difference is in an exaggerated manner). A space 66 is formed between the guide hole 62 and the adjuster rod 63. The space 66 connects the lower portion of the control valve 40 with the discharge chamber 9 thereby drawing refrigerant gas to the ports 49. Some of the refrigerant gas in the discharge chamber 9 is thus conducted to the crank chamber 3 by the ports 49. Since the space 66 is very narrow, the space 66 functions as a fixed restriction.

In addition to blowby gas leaking to the crank chamber 3 from the cylinder bores 1*a*, refrigerant gas flowing through the space 66 is also supplied to the crank chamber 3.

Changes of the suction pressure Ps, which is applied to the pressure sensing chamber 53, actuate the pressure sensing mechanism, which includes the diaphragm 54. Accordingly, the axial position of the valve body 50 is changed, which varies the opening amount of the bleeding passage (36, 49, 46, 48, 35). When the valve body 50 contacts the step 47, the bleeding passage is closed. At this time, flow of refrigerant gas from the crank chamber 3 to the suction chamber 8 is stopped. As a result, gas is supplied to the crank chamber 3 via the cylinders 1*a* (blowby gas) and via the space 66, which increases the crank chamber pressure Pc. The increase of the crank chamber pressure Pc decreases the inclination of the plates 17, 18. Accordingly, the displacement of the compressor is decreased.

When the valve body 50 is separated from the step 47, or when the bleeding passage is open, refrigerant gas flows from the crank chamber 3 to the suction chamber 8. If the amount of refrigerant gas flowing from the crank chamber 3 to the suction chamber 8 via the bleeding passage is greater than the total amount of blowby gas and gas flowing through the space 66, the crank chamber pressure Pc is lowered and the inclination of the plates 17, 18 is increased. If the amount of refrigerant gas entering the crank chamber 3 is equal to the amount of refrigerant gas escaping from the crank chamber 3, the crank chamber pressure Pc does not change. The inclination of the plate 17, 18 is determined, accordingly.

The valve sensing mechanism actuates the valve body 50 such that the suction pressure Ps is substantially equal to the target value Pset. A pressure Ps' at the outlet of the evaporator 33 represents the thermal load. The role of the compressor in the refrigerant circuit is to control the pressure Ps' to a desired level. Therefore, the compressor feedback controls the inclination of the plates 17, 18, or the compressor displacement, by the control valve 40 such that the suction pressure Ps, which is substantially equal to the pressure Ps', is maintained at the target value Pset.

When the pressure of refrigerant gas discharged from the compressor to the refrigerant circuit 30, or the discharge pressure Pd, is relatively great, pressure loss in the passages of the refrigerant circuit 30 is increased. This increases the difference between the pressure Ps' at the evaporator outlet and the suction pressure Ps. For example, the greater the discharge pressure Pd is, the smaller the suction pressure Ps is than the pressure Ps' at the evaporator outlet.

The adjuster rod 63 compensates the difference between the suction pressure Ps and the pressure Ps' thereby maintaining the pressure Ps' to a desired level. Specifically, the higher the discharge pressure Pd is, the greater the power of the adjuster rod 63 to lift the entire pressure sensing mechanism by the valve body 50 is. The axial urging force of the adjuster rod 63, which is determined in accordance with the discharge pressure Pd, acts against the axial urging force of the spring 58 through the valve body 50 and the parts of the pressure sensing mechanism (52, 55, 54, 61, 60, 59). In other words, the adjuster rod 63 adjusts the target value Pset of the suction pressure Ps in accordance with the level of the discharge pressure Pd. Therefore, even if the discharge pressure Pd is so high that there is a great difference between the suction pressure Ps and the pressure Ps', the opening of the control valve 40 is controlled such that the pressure Ps' is stabilized in a desired pressure range.

The illustrated embodiment of FIGS. 1 to 3, has the following advantages.

Sufficient refrigerant gas is constantly supplied to the crank chamber 3 by blowby gas from the cylinder bores 1*a* and gas flowing through the space 66. Therefore, although the compressor uses the outlet control valve 40, the inclination of the plates 17, 18 is quickly changed.

The space 66, which conducts refrigerant gas from the discharge chamber 9 to the crank chamber 3, is formed by the clearance between the adjuster rod 63 and the guide hole 62 in the outlet control valve 40. Therefore, there is no need to form a passage for supplying gas from the discharge chamber 9 to the crank chamber 3, which reduces the manufacturing cost. Thus, the compressor having the illustrated valve 40 is suitable for mass production.

It should be apparent to those skilled in the art that the present invention may be embodied in many other specific forms without departing from the spirit or scope of the invention. Particularly, it should be understood that the invention may be embodied in the following forms.

Figure 4:
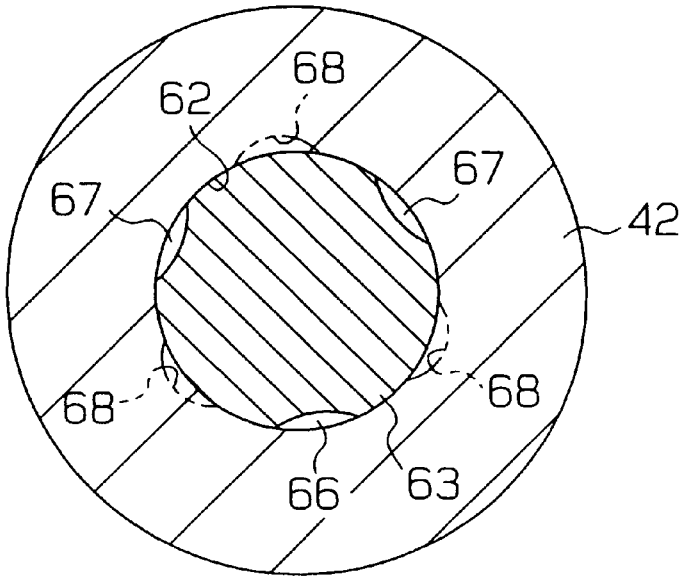
FIG. 4 is a cross-sectional view like FIG. 3, illustrating a second embodiment.

As shown in FIG. 4, the diameter of the adjuster rod 63 may be substantially the same as the diameter of the guide hole 62. In this case, one or more grooves 67 are formed in the circumferential surface of the rod 63. The number of the grooves 67 is three in the drawing. The grooves 67 function in the same way as the space 66 of FIGS. 2 and 3. Alternatively, guide grooves 68 may be formed in the inner wall of the guide wall 62 as illustrated by two-dot chain line in FIG. 4.

Figure 5:
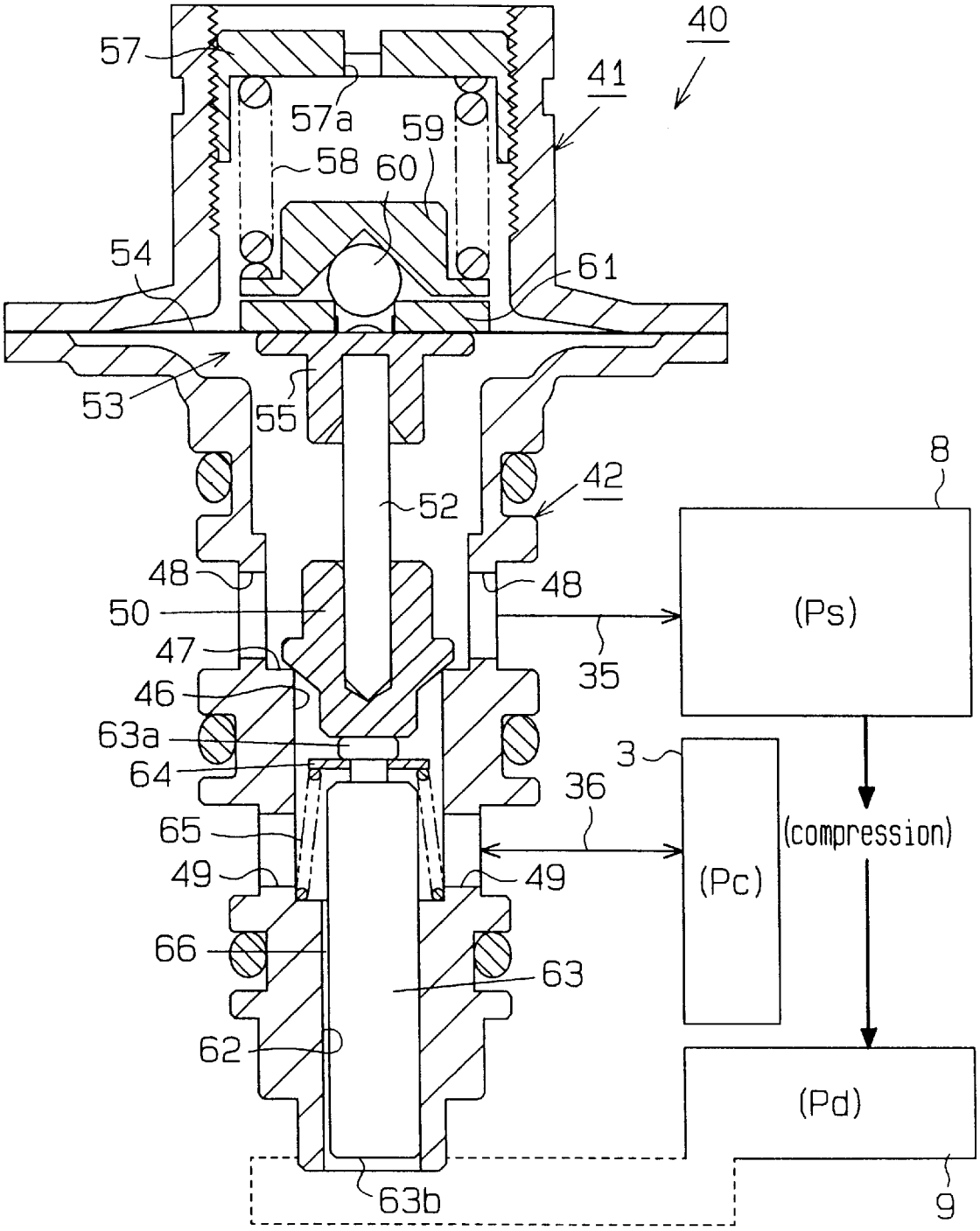
FIG. 5 is an enlarged cross-sectional view illustrating an outlet control valve according to a third embodiment.

The plug 43, the disk spring 44, the seal ring 45 and the ports 56 may be omitted. That is, as shown in FIG. 5, the upper portion of the valve chamber 46 may function as the pressure sensing chamber 53 and the chamber 53 may be connected to the suction chamber 8 by the passage 35. This valve functions like the valve 40 of FIG. 2.

As a pressure sensing body, a bellows may replace the diaphragm 54.

The control valve 40 of FIGS. 2 and 5 is a self-controlled type, which operates in accordance with the suction pressure Ps. However, the present invention may be embodied in an externally controlled type control valve, which is controlled by electrical signals supplied from an outside controller.

The outlet control valve according to the illustrated embodiments may be used in compressors other than the compressor of FIG. 1, which has the drive plate 17 and the wobble plate 18. For example, the present invention may be embodied in swash plate type compressors, in which an inclined swash plate reciprocates pistons.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement compressor for varying displacement according to the inclination of a drive plate located in a crank chamber, the compressor comprising:

a suction pressure zone, the pressure of which is a suction pressure;

a discharge pressure zone, the pressure of which is a discharge pressure;

a bleeding passage for bleeding refrigerant gas from the crank chamber to the suction pressure zone; and a valve for regulating the bleeding passage, wherein the valve controls the flow of refrigerant gas from the crank chamber to the suction pressure zone such that the valve adjusts the pressure of the crank chamber, and the inclination of the drive plate varies in accordance with the pressure in the crank chamber, wherein the valve has a valve body, which adjusts the opening area of the bleeding passage, an adjuster body, which acts on the valve body, and a housing that houses the adjuster body, wherein a supply passage is formed between the adjuster body and the housing to guide refrigerant gas from the discharge pressure zone to the crank chamber.

2. The compressor according to claim 1, wherein the adjuster body urges the valve body in one direction in accordance with the discharge pressure.

3. The compressor according to claim 2, wherein the valve has a pressure sensing mechanism, which actuates the valve body in accordance with the suction pressure such that the suction pressure seeks a predetermined target value, and wherein the adjuster body serves as to modify the target value in accordance with the discharge pressure.

4. The compressor according to claim 1, wherein the housing has a valve chamber, which constitutes part of the bleeding passage, wherein the valve chamber accommodates the valve body, wherein the valve chamber has a first section that is connected to the suction pressure zone and a second section that is connected to the crank chamber, wherein the adjuster body has a first end and a second end, wherein the first end is located in the second section and abuts against the valve body, and the second end is exposed to the discharge pressure.

5. The compressor according to claim 4, wherein the supply passage connects the discharge pressure zone to the second section.

6. The compressor according to claim 1, wherein the housing includes a guide bore, which is occupied by the adjuster body, wherein the diameter of the guide bore is greater than the corresponding dimension of the adjuster body.

7. The compressor according to claim 1, wherein the supply passage is a groove that extends along the axis of the adjuster body.

8. The compressor according to claim 1, wherein the supply passage serves as a fixed flow restrictor.

9. A valve for controlling the displacement of a variable displacement compressor, wherein the compressor includes a suction pressure zone, the pressure of which is a suction pressure, a discharge pressure zone, the pressure of which is a discharge pressure, and a bleeding passage, which bleeds refrigerant gas from a crank chamber to the suction pressure zone, the valve comprising:

a valve housing;

a valve chamber defined in the valve housing, wherein the valve chamber forms part of the bleeding passage;

a valve body accommodated in the valve chamber such that the valve body adjusts an opening area of the bleeding passage; and an adjuster rod that is movably supported by the valve housing such that the adjuster rod controls the motion of the valve body, wherein the adjuster rod urges the valve body in one direction in accordance with the discharge pressure, wherein a passage is defined between the adjuster rod and the valve housing such that the passage conducts refrigerate gas from the discharge pressure zone to the crank chamber.

10. The valve according to claim 9, wherein the valve has a pressure sensing mechanism, which actuates the valve body in accordance with the suction pressure such that the suction pressure seeks a predetermined target value, wherein the adjuster rod serves to modify the target value in accordance with the discharge pressure.

11. The valve according to claim 9, wherein the valve chamber has a first section that is connected to the suction pressure zone and a second section that is connected to the crank chamber, wherein the adjuster rod has a first end and a second end, wherein the first end is located in the second section and abuts against the valve body, and the second end is exposed to the discharge pressure.

12. The valve according to claim 11, wherein the passage connects the discharge pressure zone to the second section.

13. The valve according to claim 9, wherein the housing includes a guide bore, which is occupied by the adjuster rod, wherein the diameter of the guide bore is greater than the diameter of the adjuster rod.

14. The valve according to claim 9, wherein the passage serves as a fixed flow restrictor.

15. The valve according to claim 9, wherein the passage is a groove that extends along the axis of the adjuster rod.

* * * * *